United States Patent [19]

Doerner et al.

[11] 3,986,852

[45] Oct. 19, 1976

[54] ROTARY COOLING AND HEATING APPARATUS

[75] Inventors: William A. Doerner; Oral R. Van Buskirk, both of Wilmington, Del.

[73] Assignee: E. I. Du Pont de Nemours and Company, Wilmington, Del.

[22] Filed: Apr. 7, 1975

[21] Appl. No.: 565,829

[52] U.S. Cl. ..... 62/467 R; 62/499; 165/86

[51] Int. Cl.[2] ..... F25B 3/00

[58] Field of Search ..... 62/324, 325, 467, 499; 165/86, 87, 88; 60/669; 122/11

[56] References Cited

UNITED STATES PATENTS

| | | | |
|---|---|---|---|
| 2,811,841 | 11/1957 | Grimshaw | 62/467 |
| 3,001,384 | 9/1961 | Hanson | 62/499 |
| 3,773,106 | 11/1973 | Levy | 165/86 |
| 3,863,454 | 2/1975 | Doerner | 62/499 |
| 3,877,515 | 4/1975 | Laing | 62/499 |
| 3,911,694 | 10/1975 | Doerner | 62/499 |

*Primary Examiner*—William F. O'Dea
*Assistant Examiner*—Ronald C. Capossela

[57] ABSTRACT

Rotary cooling and heating apparatus comprising a rotary housing containing a refrigerant compressor, a refrigerant expander rotatable with the housing and an external refrigerant condenser and evaporator. The components are disposed on a common axis for coaxial rotation together as a unit, and rotary power means rotationally drives the compressor and the housing-condenser-evaporator unit at predetermined different speeds. The refrigerant expander is completely self-regulating and is constructed to operate in a highly stable manner essentially adiabatically with no nucleate boiling of the refrigerant in the expander.

19 Claims, 11 Drawing Figures

ROTARY COOLING AND HEATING APPARATUS

This invention relates to rotary cooling and heating apparatus. More particularly, the invention relates to rotary cooling apparatus comprising a rotary expander in which expansion of the refrigerant is adiabatic and operable automatically to regulate the flow of refrigerant and maintain capacity balance in the system for all operating conditions.

In a vapor compression refrigeration system, expansion of the high pressure liquid condensate to the low pressure in the evaporator produces a cooled mixture of liquid and vapor. Normally, the expansion process is carried out with a capillary tube or an expansion valve.

An essential feature of any refrigeration system is control of refrigerant flow. Capillary tube expanders have the inherent ability to meter the refrigerant flow but only over a limited range of conditions. Thermostatic expansion valves control refrigerant flow over a wide range of conditions but are more complex and expensive.

With the foregoing in mind, an object of the present invention is to provide rotary cooling and heating apparatus having a refrigerant expander that is self-regulating and operable essentially adiabatically with no nucleate boiling of the refrigerant in the expander.

Another object of the invention is to provide rotary cooling and heating apparatus having an expander as set forth that is inexpensive, of simple construction and has no moving parts relative to the rotating system in which the expander is located.

Another object of the invention is to provide rotary cooling and heating apparatus having a refrigerant expander of the type described that functions in a highly stable manner and is devoid of any pressure, temperature, or flow rate pulses regardless of fluctuations in operating conditions.

A further object of the invention is to provide rotary cooling and heating apparatus that is constructed and operable to provide positive reliable automatic refrigerant flow control for all operating conditions without the necessity for any complicated control mechanism.

These and other objects of the invention and the features and details of the construction and operation of certain embodiments thereof, are hereinafter set forth and described with reference to the accompanying drawings, in which.

Figure 1:
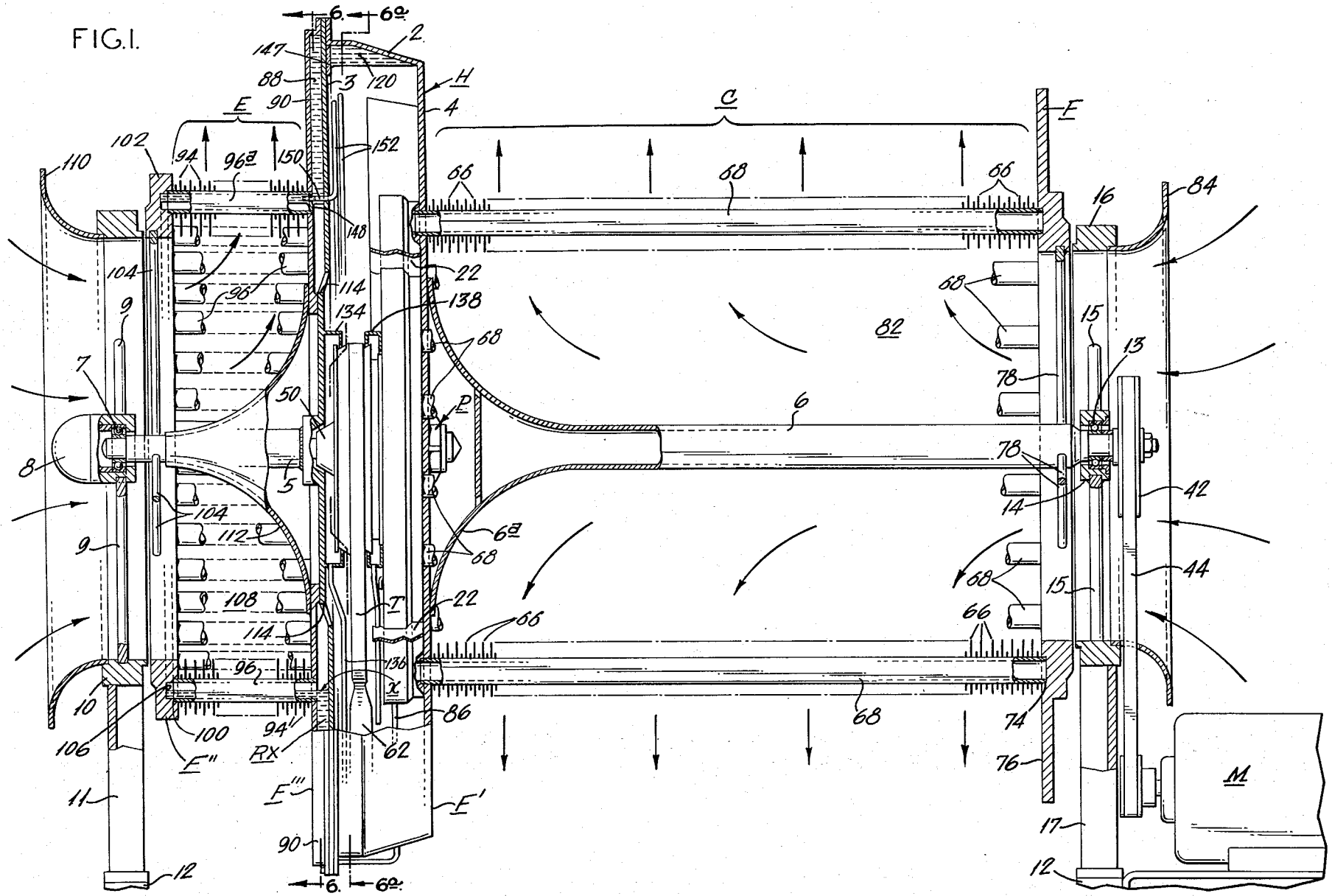
FIG. 1 is a typical sectional view diametrically through an embodiment of rotary cooling apparatus according to the present invention.
Figure 2:
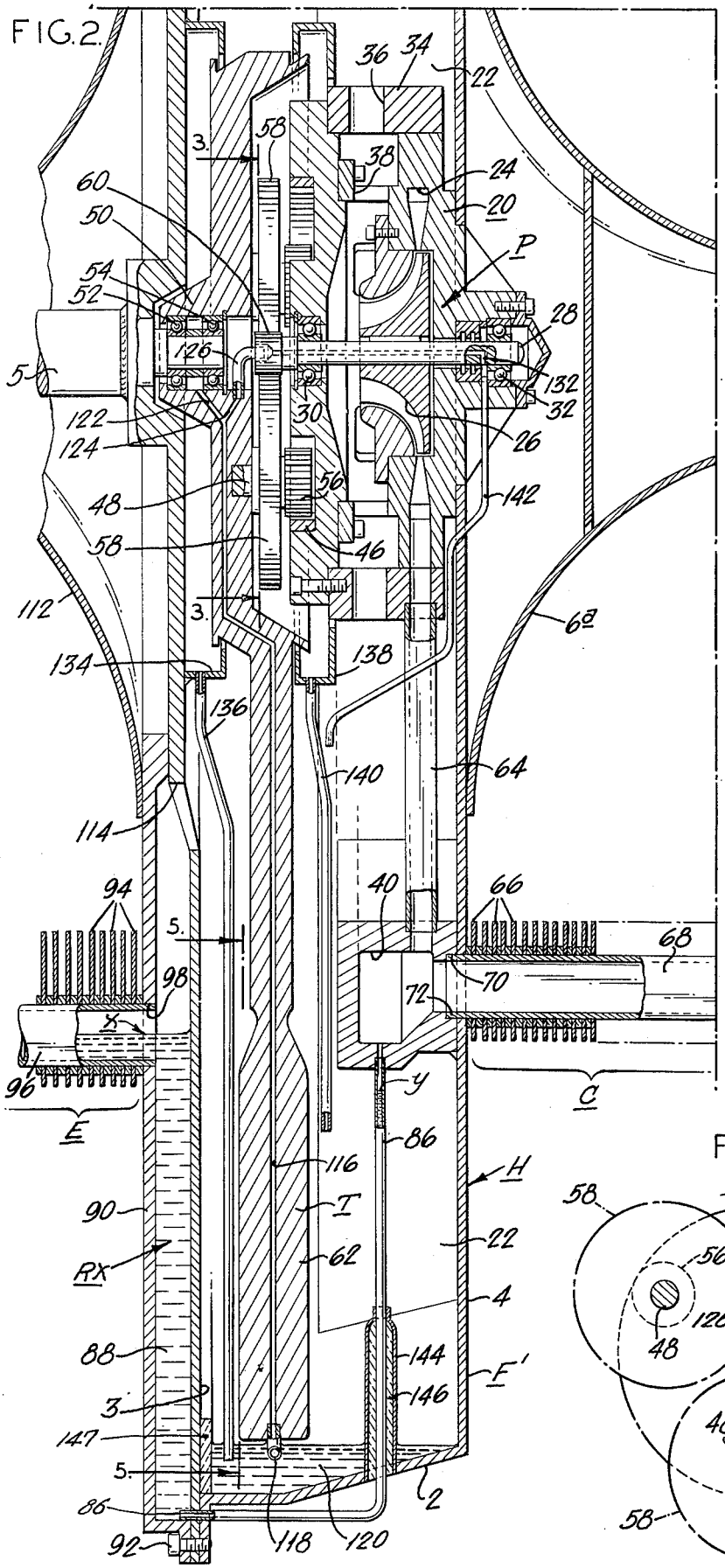
FIG. 2 is an enlarged fragmentary vertical sectional view diametrically through the rotary cooling apparatus shown in FIG. 1.
Figure 8:
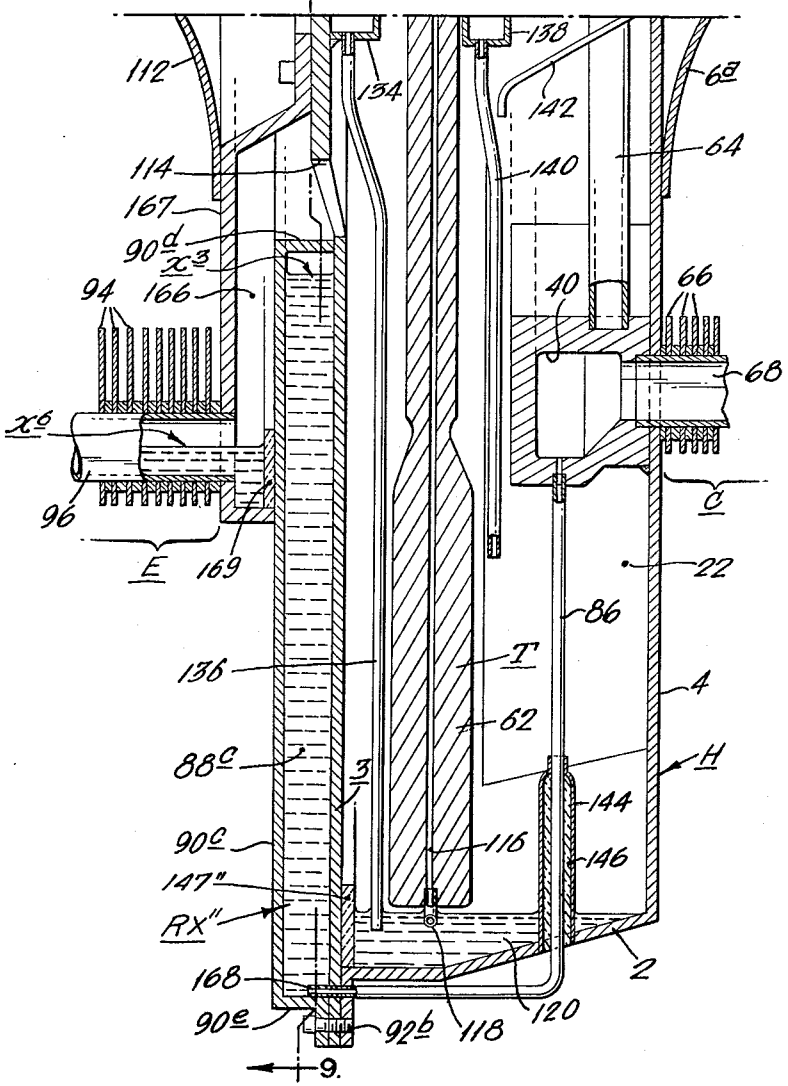
Figure 7:
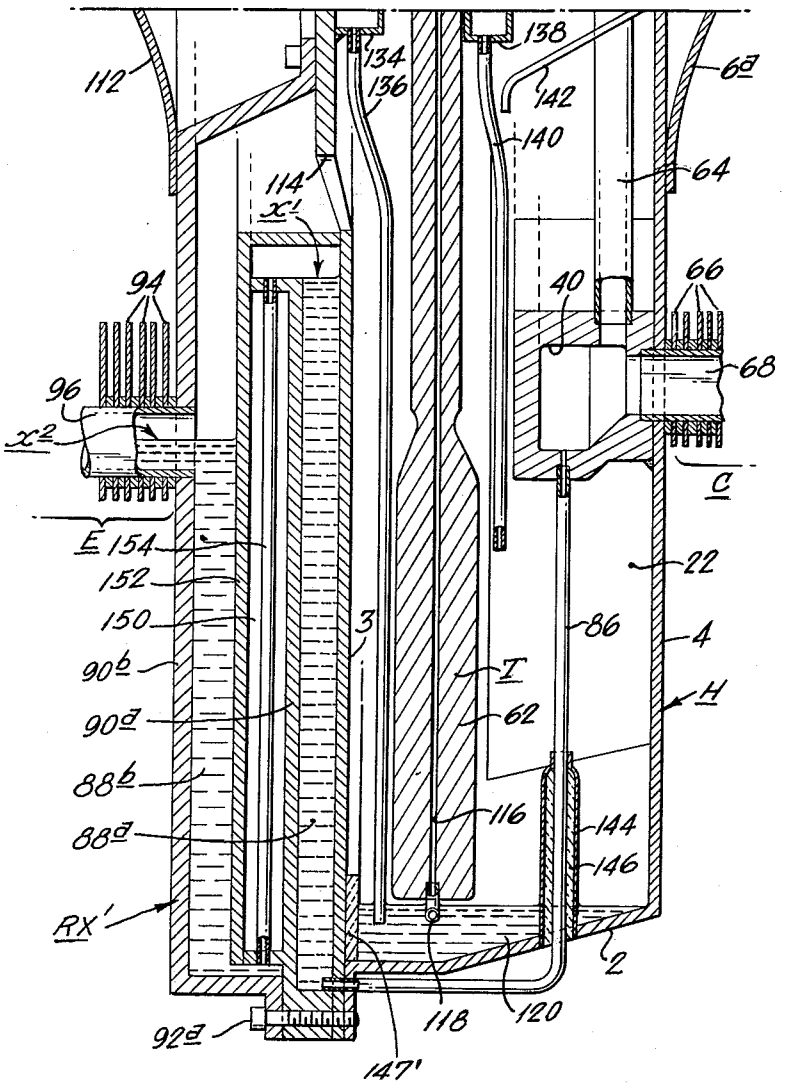
Figure 9:
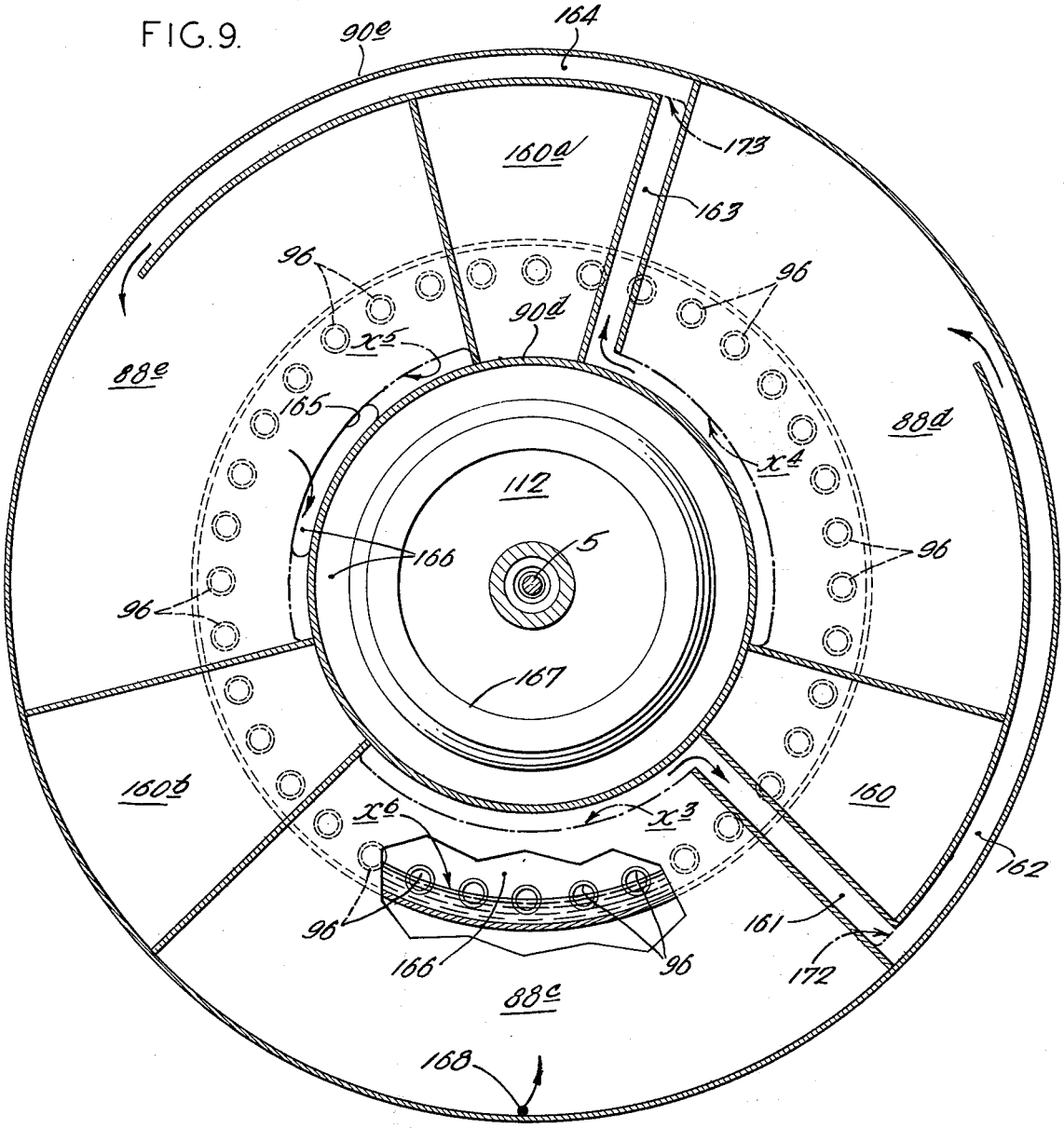

FIG. **6*a* is a sectional view in reduced scale on line 6*a* — 6*a*, FIG. 1**;

FIG. 7 is a view similar to FIG. 2 showing a modification of the present invention;

FIG. 8 is a view similar to FIG. 7 showing another modification of the invention;

FIG. 9 is a sectional view on line 9—9, FIG. 8, and

Figure 10:
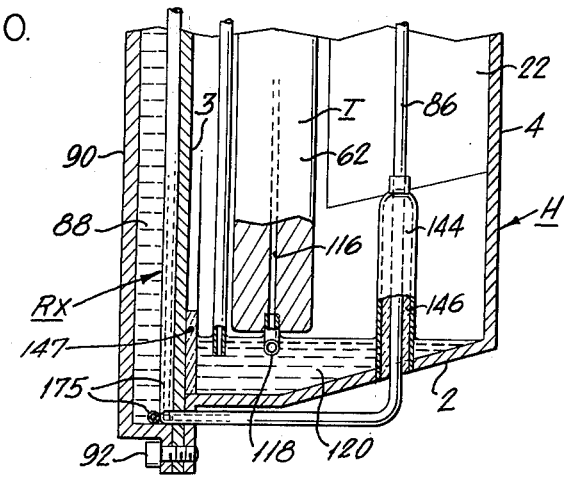

FIG. 10 is a view similar to FIGS. 7 and 8 showing a further modification of the invention.

Rotary cooling and heating apparatus according to the present invention is generally similar in construction to the apparatus shown and described in my copending application for U.S. Pat. Ser. No. 457,374, filed Apr. 2, 1974, now U.S. Pat. No. 3,911,694 and comprises a rotary hermetically sealed housing H containing a refrigerant compressor P and refrigerant expander RX, together with external refrigerant condenser C and evaporator E. The components are mounted on a common axis with the condenser C and evaporator E axially spaced at opposite sides of the housing H and mounted for coaxial rotation with the housing as a unit about said axis. Rotary power means are provided to rotationally drive the compressor P and housing-condenser-evaporator unit, and a fixed-ratio transmission in the housing is connected between the latter and the compressor to provide predetermined different rotational speeds for the compressor and the housing-condenser-evaporator unit.

The particular improvement in the apparatus of the present invention resides in the refrigerant expander which comprises at least one radially extending chamber rotatable with the housing H having its outer periphery disposed at a predetermined radius from the rotation axis of the housing and adapted to be filled with liquid refrigerant to a surface level disposed at a predetermined less radius from said rotation axis. According to the invention, liquid refrigerant from the condenser is supplied to the expander chamber at the outer periphery thereof, and the outer peripheral radius of said chamber and the radius of the liquid surface level therein are predetermined in correlation to one another and to the speed of rotation of the chamber to provide a pressure differential, cooperable with the temperature difference between the warmer liquid entering the chamber from the condenser and the cooler liquid at the said surface level, to cause radial circulation and intermixing of the warmer and cooler portions of the liquid in the chamber. Circulation and intermixing of the warmer and cooler portions of the liquid refrigerant as described prevents nucleate boiling of the refrigerant liquid in the expander chamber but permits quiescent convective boiling of the refrigerant at the liquid surface level resulting in vaporization of some of the refrigerant with the remainder of the liquid refrigerant overflowing from the chamber to the evaporator E where it is vaporized.

Figure 3:
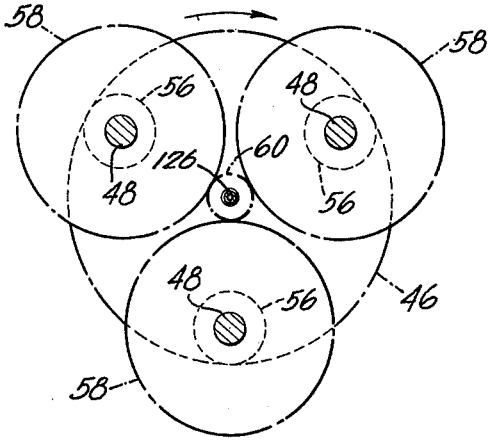
FIG. 3 is a schematic view on line 3—3, FIG. 2 of the fixed-ratio gear train.

In the embodiment of the invention shown in FIGS. 1–3 of the drawings, and with particular reference to FIG. 1 thereof, the rotary housing H is of generally cylindrical configuration comprising a circumferentially extending peripheral wall 2 and axially spaced side walls 3 and 4. The housing H is mounted for rotation about its axis by means of shaft members 5 and 6 secured to and extending coaxially outward from the opposite housing side walls 3 and 4, respectively. The outer end of the shaft 5 is journaled by means of a bearing 7 in a stationary hub 8 that is fixedly supported by means of radial spokes 9 from a circumscribing concentric ring 10 that in turn is fixedly supported by a standard 11 from a fixed base or support 12 of the apparatus. In similar manner, the outer end of the shaft 6 is rotatably journaled by means of a bearing 13 in a stationary collar or ring 14 that is supported by means of radial spokes 15 within a circumscribing concentric ring 16 that is in turn fixedly supported by a standard 17 from the fixed base 12 of the apparatus. From the foregoing it will be apparent that the cylindrical housing H and the shafts 5 and 6 constitute a unitary structure that is mounted for coaxial rotation as a unit about the housing axis.

Mounted coaxially within the housing H is a refrigerant compressor or pump P. The compressor P comprises an annular housing structure 20 that is fixedly supported within the housing H by means of radial vanes 22 so that the compressor housing 20 rotates coaxially as a unit with the housing H. The compressor housing 20 defines internally thereof a coaxial annular chamber 24 in which is mounted a compressor rotor 26 that is keyed to a shaft 28 journaled in the compressor housing 20 by means of bearings 30 and 32. Fixedly secured to and circumscribing the compressor housing 20 is an annular ring 34 having circumferentially arranged radial openings 36 therein that communicate with a corresponding plurality of circumferentially arranged radial inlet passages 38 leading to the compressor rotor 26. An annular refrigerant chamber 40 coaxially surrounds the compressor P in radially spaced relation thereto and is fixedly supported within the housing H to rotate with the compressor housing 20 and said housing H.

In the embodiment of the invention illustrated in FIG. 1 of the drawings, the housing H is rotationally driven at a predetermined speed by means of an external electric motor M driving a pulley 42, fixed on the outer end of the housing shaft 6, through a belt or chain 44. An internal transmission is provided between the housing H and the compressor rotor shaft 28 so that the rotation of said housing driven by the motor M operates to rotationally drive the said shaft 28 and compressor rotor 26 at the desired speed. In the embodiment of the invention shown in FIGS. 1 and 2, this is accomplished by means of an internal occluded fixed-ratio gear train arranged coaxially within the housing H, and constructed and operable as described in U.S. Pat. No. 3,769,796 issued Nov. 6, 1973 in the name of Max F. Bechtold.

As shown in FIGS. 2 and 3, the fixed-ratio gear train is in the form of a planetary gear system comprising a ring gear 46 fixedly mounted on and rotatable with the compressor housing 20 at the rotational speed at which said housing 20 and main housing H are driven by the motor M. The ring gear 46 drives a plurality of compound gears each rotatably mounted by means of bearings on a stub shaft 48 that is fixedly mounted in the adjacent portion of a non-rotating torque anchor member T having a coaxially disposed central hub portion 50 that is journaled on the inner end of the shaft 5 by means of axially spaced bearings 52,54. As shown, the ring gear 46 is meshed with and rotationally drives the smaller diameter gear 56 of each compound gear and the larger diameter gear 58 of each compound gear is meshed with and rotationally drives a coaxial sun gear 60 fixedly secured on the compressor shaft 28.

The torque anchor T is held stationary with respect to the rotary housing H by means of a pendulum portion 62 that projects radially substantially to the circumferential wall 2 of the housing. The pendulum is of predetermined density, dimensions and location to generate the necessary counter-torque force to oppose the reaction torque generated by the compressor.

By reason of the non-rotating torque anchor T one element of the gear train, namely the compound planetary gears, are fixedly positioned so that their axes do not rotate or move circumferentially relative to or about the housing axis. Thus the rotary power of the housing H is transmitted from the rotating ring gear 46 through the compound planetary gears directly to the sun gear 60 on the compressor shaft 28 thereby rotationally driving said shaft and the compressor rotor 26 at the desired predetermined speed in accordance with the fixed-ratio of the gear train to compress the selected refrigerant such as, for example, Freon 113 or the like. On the other hand, with an internal motor such as in my aforesaid Application Ser. No. 457,374 the compressor is driven directly and the pendulum provides the necessary counter-torque force to oppose the external reaction torque of the air drag in the rotary condenser C and evaporator E.

Refrigerant compressed by the rotor 26 is discharged therefrom through a plurality of circumferentially equally spaced radial tubes 64 to the annular refrigerant chamber 40. Compressed refrigerant discharged from the compressor P to the chamber 40 is condensed in the rotary condenser C. As shown, the rotary condenser C comprises a coaxial array of annular radial fins 66 and longitudinally extending heat exchange tubes 68 arranged circumferentially in equally spaced relation about the rotation axis of the apparatus and mounted to rotate with the housing H as previously stated. The fins 66 consist of separate or independent annular disk elements supported and secured in predetermined equally spaced parallel relation by means of the heat exchange tubes 68 that extend longitudinally through said fins 66. The fins 66 and tubes 68 are fabricated of metal having high thermal conductivity and preferably the fins are bonded to the tubes to provide maximum thermal conductivity therebetween.

The inner end portions of the heat exchange tubes 68 extend through openings 70 in the housing wall 4 and have their ends secured in recesses 72 in the adjacent wall of the refrigerant chamber 40 with the interiors of said tubes 68 in communication with the interior of said chamber 40 to receive compressed refrigerant therefrom. The outer ends of the tubes 68 are mounted and secured in recesses 74 provided in an annular end ring 76 disposed coaxially adjacent the outermost of the fins 66 and supported from the housing shaft 6 by circumferentially equally spaced radial spokes 78.

The inner peripheral edges of the fins 66 define internally thereof a coaxial inlet chamber 82 for the cooling fluid to be discharged outwardly by and between the plurality of rotating fins as hereinafter set forth. The inner diameters of the ring 16 and ring 76 are the same as the inner diameter of the adjacent group of fins 66 so as not to restrict the flow of fluid inwardly to the chamber 82, and an outwardly flared or bell-shaped fluid intake member 84 is fixedly mounted on the ring 16 in coaxial relation outwardly adjacent the inlet end of the chamber 82. The inner end portion of the housing shaft 6 is of curved generally conical shape as indicated at **6*a* for streamlining flow of the heat exchange fluid through the chamber 82 to the fins 66** of the condenser. The nature of the flow for rotational shear force devices is completely described by the Taylor number, $N_{Ta}$, where:

$$N_{Ta} = d^2w/v$$

$d$ = distance between fins
$w$ = angular velocity (radians per sec.)
$\nu$ = kinematic viscosity Efficient heat exchange depends upon both the fin area and the difference between the speed of the fins and the velocity of the fluid flowing between them. For heat transfer, the Taylor number is not adequate by itself to completely describe an optimum configuration and must be determined with relation to the ratio of the inner radius to the outer radius of the fins to provide an efficient heat exchanger.

Thus, the spacing or distance between the adjacent fins 66 of the condenser C is determined with relation to the rotational speed of the condenser and to the kinematic viscosity of the cooling fluid to provide a Taylor number in the range of about 5 to 10, preferably about 6, and the inner radius and outer radius of the fins is determined to provide a ratio of inner to outer radii of the fins 66 in the range of about 0.70 to 0.85, preferably about 0.77, so as to utilize the viscous properties of the cooling fluid and the shear forces exerted thereon by the rotating fins 66 to convey and accelerate the fluid radially outward between said fins substantially to the velocity providing optimum total heat exchange between refrigerant in the tubes 68 and the fluid passing between the fins 66 in accordance with the invention set forth and described in U.S. Pat No. 3,866,668 issued Feb. 18, 1975.

The outer peripheral portion of both the housing wall 4 and the ring 76 extend radially outward beyond the fins 66 a distance to provide annular radial flange portions F and F′, respectively, that operate to augment fluid flow outwardly between the fins 66 as described in U.S. Pat. of Stanley B. Levy, No. 3,773,106, issued Nov. 20, 1973. Also, longitudinal fluid flow augmentation blades of the type and construction shown and described in said Levy patent can be provided between the flange portions F and F′ when desired in any particular installation.

Compressed refrigerant discharged by the rotor 26 to the annular chamber 40 flows from the latter into the heat exchange tubes 68 of the condenser C where it is condensed by heat exchange with the cooling fluid, for example air, discharged outwardly between the array of fins 66 as previously described. The liquid refrigerant thus condensed in the condenser tubes 68 flows inwardly therein to the refrigerant chamber 40 from which it is discharged by centrifugal force outwardly through a plurality of circumferentially equally spaced radially extending feed tubes 86 to the refrigerant expander RX which rotates with the housing H and operates essentially adiabatically.

Figure 6:
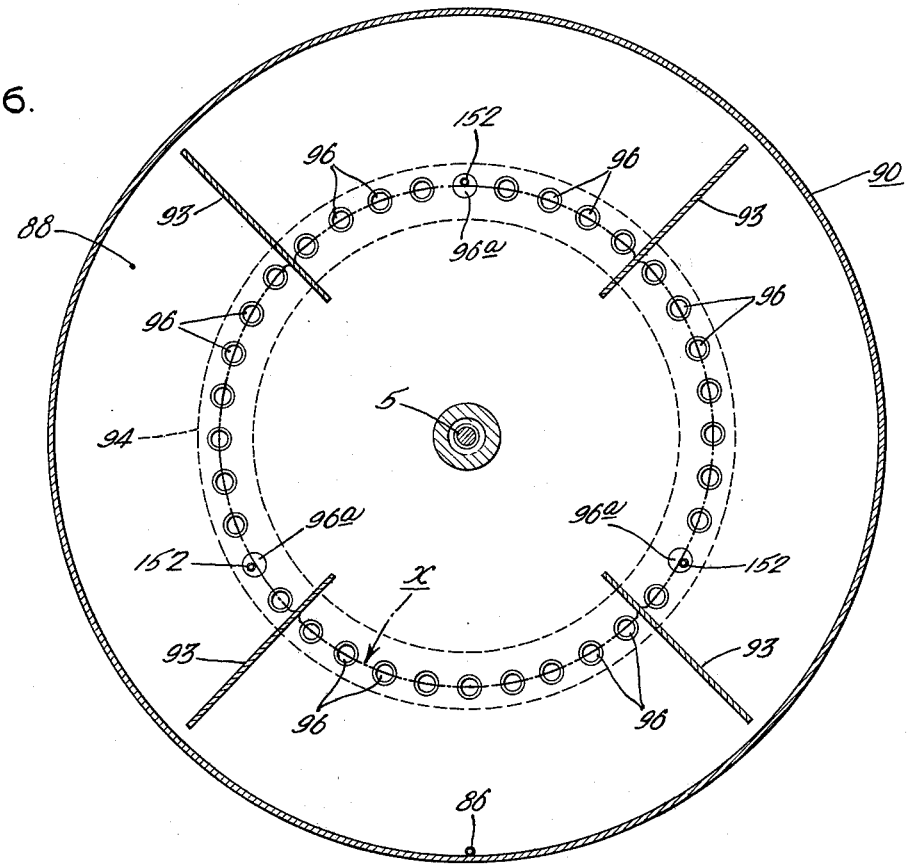
FIG. 6 is a sectional view in reduced scale on line 6—6, FIG. 1.

In the illustrated embodiment of the invention, the expander RX comprises a coaxial annular radially extending chamber 88 that is provided outwardly adjacent the housing side wall 3 by an annular plate 90 which is secured in axially spaced relation to said housing side wall 3, for example by bolts 92. The expander chamber 88 has a radial dimension substantially coextensive with the housing wall 3 and a comparatively short axial dimension as shown. The condensed refrigerant feed tubes 86 are connected to the expander chamber 88 at the outer periphery thereof, and a plurality of radial baffles 93 is provided in the expander chamber 88, as shown in FIG. 6, to maintain the angular velocity of the liquid refrigerant therein substantially the same as that of the rotary housing H thereby reducing angular momentum of the liquid and extracting work therefrom.

The outer periphery of the expansion chamber 88 is disposed at a predetermined radius from the rotation axis of the housing and the feed tubes 86 supply liquid refrigerant from the condensate chamber 40 as required to fill the chamber 88 with liquid refrigerant to the surface level indicated $x$ which is disposed at a predetermined less radius from the rotation axis. The outer peripheral radius of the chamber 88 and the radius of the liquid surface level $x$ therein are predetermined in correlation to one another and to the speed of rotation of the housing to provide a pressure differential, cooperable with the temperature difference between the warmer liquid entering the chamber from the condenser and the cooler liquid at the said surface level $x$, to cause radial circulation and intermixing of the warmer and cooler portions of the liquid in the chamber. Circulation and intermixing of the warmer and cooler portions of the liquid refrigerant as described prevents nucleate boiling of the refrigerant liquid in the expansion chamber but permits quiescent convective boiling of the refrigerant at the surface level $x$ resulting in vaporization of some of the refrigerant at that surface with the remainder of the liquid refrigerant flowing into the tubes 96 of the evaporator E where it is vaporized.

The evaporator E is generally similar in construction to the condenser C previously described, and comprises a coaxial array of annular radial fins 94 and longitudinally extending heat exchange tubes 96 arranged in circumferentially equally spaced relation about the shaft 5 and mounted for rotation with the housing H and condenser C as a unit.

The inner ends of the heat exchange tubes 96 are mounted and secured in corresponding openings 98 provided in the annular plate 90 so that the interiors of the tubes 98 are in communication with the interior of the expander chamber 88. The outer ends of the tubes 96 are mounted and secured in recesses 100 provided in an annular end ring 102 that is disposed coaxially adjacent the outermost of the fins 94 and supported from the shaft 5 by circumferentially equally spaced radial spokes 104. The outer ends of the evaporator tubes 96 communicate with and are interconnected by an annular manifold 106 provided in the ring 102.

Referring to FIG. 1 of the drawings, the inner peripheral edges of the fins 94 define interiorly thereof a coaxial inlet chamber 108 for the heat exchange fluid to be discharged outwardly by and between the plurality of rotating fins 94 in the manner previously described in connection with the condenser C. The inner diameters of the ring 102 and the outwardly adjacent ring 10 are the same as the inner diameter of the fins 94 so as not to restrict the flow of fluid into the chamber 108 and an outwardly flared or bell-shaped intake member 110 is fixedly mounted on the ring 10 in coaxial relation outwardly adjacent the inlet end of the chamber 108. A curved, generally conical shaped cowl 112 surrounds the shaft 5 for streamlining flow of the heat exchange fluid through chamber 108 to the array of fins 94 of the evaporator E.

As in the case of the condenser C, the spacing or distance between the adjacent fins 94 of the evaporator E is determined with relation to the rotational speed of the evaporator and to the inner and outer radii of said fins 94, as previously described, so as to utilize the viscous properties of the fluid and the shear forces exerted thereon by the fins 94 to convey and accelerate the fluid radially outward between the fins substantially to the velocity providing optimum total heat exchange between the fluid discharged through the fins 94 and the refrigerant in the tubes 96.

Liquid is supplied by the feed tubes 86 to the evaporator chamber 88 at the rate required to fill the chamber 88 and evaporator tubes 96 to the level *x* at which the evaporator tubes 96 are half filled with liquid refrigerant. The liquid in the expander chamber 88 is essentially all at evaporator temperature so that the warm liquid condensate entering the expander chamber from the feed tubes 86 experiences high convection currents. However, no nucleate boiling of the liquid occurs anywhere in the expander chamber 88, but quiet convective boiling and vaporization does occur at the annular surface level *x* of the liquid in the expander chamber 88.

The vapor produced by this convective boiling at the surface *x* of the liquid in the chamber 88 joins the vapor produced by vaporization of the liquid in the evaporator E and all of the vapor flows through a plurality of openings 114 in the adjacent housing side wall 3 to the interior of the housing H and thence through the inlet passages 36 and 38 to the compressor P where it is again compressed and the cycle repeated. Essentially, all of the inventory of refrigerant in the expander chamber 88 and evaporator tubes 96 is in the liquid phase during operation of the apparatus. As the compressor pressure increases, the liquid level *y* in the expander feed tubes 86 will move radially outward automatically to balance the differences in pressure between the condenser C and evaporator E regardless of the mass flow rate of the refrigerant.

While it is preferred in the case of high boiling point refrigerants such as Freon 113 previously mentioned, that the liquid level *x* in the expander chamber 88 and evaporator tubes 96 be at a greater radial distance from the rotation axis of the apparatus than the refrigerant condenser tubes 68 as shown in FIGS. 1 and 2, this is not necessary in the case of lower boiling point refrigerants and with some such refrigerants the liquid level *x* may be at a less radial distance from the axis than the condenser tubes 68. In either arrangement the flow rate of refrigerant through the expander feed tubes 86 is controlled by the difference in pressure between the condenser C and evaporator E and the difference in liquid level between the level *y* in the radially extending tubes 86 and the liquid level *x* in the expander 88 and evaporator tubes 96.

Figure 4:
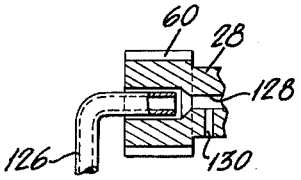
FIG. 4 is an enlarged fragmentary detail view partially in section showing the non-rotating lubricant supply conduit mounted within the high speed rotating sun gear of the gear train shown in FIG. 3.
Figure 5:
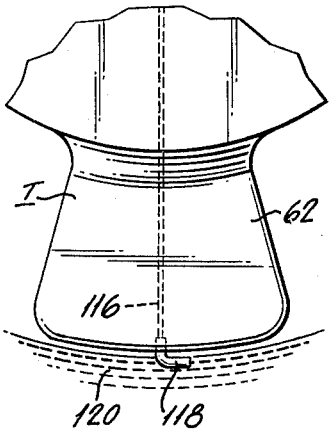
FIG. 5 is a fragmentary sectional view in reduced scale on line 5—5, FIG. 2 showing details of the torque anchor pendulum.

Incorporated in the apparatus is a force feed lubrication system utilizing a Pitot pump such as shown in FIG. 2, and of the type described in U.S. Pat. No. 3,744,246, issued July 10, 1973. As shown, the Pitot pump comprises a radial passage 116 in the pendulum 62 and torque anchor T, having at its outer end an L-shaped scoop 118, the inlet end of which is immersed in an annular bath of lubricant 120 in a sump extending circumferentially interiorly of the rotary housing H, and faces in the direction opposite the direction of rotation thereof. Adjacent the hub portion 50 of the torque anchor T the passage 116 divides into two angularly extending branch passages 122 and 124, respectively. The passage 122 conducts lubricant internally of the hub portion 50 for lubrication of the bearings 52 and 54. The other branch passage 124 connects to the radial leg of an inverted L-shaped connector 126 that has its horizontal leg disposed coaxially within the sun gear 60 of the gear train, for example as shown in FIG. 4, and the compressor rotor shaft 28 is provided with a coaxially extending lubricant passage 128 having radial passages 130 and 132, respectively, disposed for lubricating the shaft bearings 30 and 32 as well as the several gears in the fixed-ratio gear train.

Rotation of the housing H relative to the stationary torque anchor T operates to pump lubricant from the bath 120 to the bearings and gears as described. Lubricant from the bearing 52 drains into an annular collector ring 134 and is returned therefrom to the lubricant bath 120 by means of a plurality of circumferentially equally spaced tubes 136. Lubricant drains from the bearing 30 and the gear train into an annular collector ring 138 and is returned therefrom to the lubricant bath 120 by a plurality of circumferentially equally spaced tubes 140, and lubricant from the bearing 32 is returned to the bath 120 by a plurality of tubes 142.

It will be observed in FIG. 2, that a portion of each feed tube 86 adjacent the housing wall 2 passes through the lubricant bath 120, and as the temperature of the lubricant bath 120 usually is higher than the temperature of the refrigerant in the tubes 86, the portions of the latter passing through the bath 120 preferably are thermally insulated from the lubricant, for example, by means of a circumscribing tubular sheath 144 of larger diameter than said tubes 86 closed at their opposite ends and filled with suitable insulating material 146. Also, suitable insulation 147 is provided adjacent the outer periphery of the housing wall 3 to insulate the cooler refrigerant in the chamber 88 from the warmer lubricant bath 120.

Figure 6A:
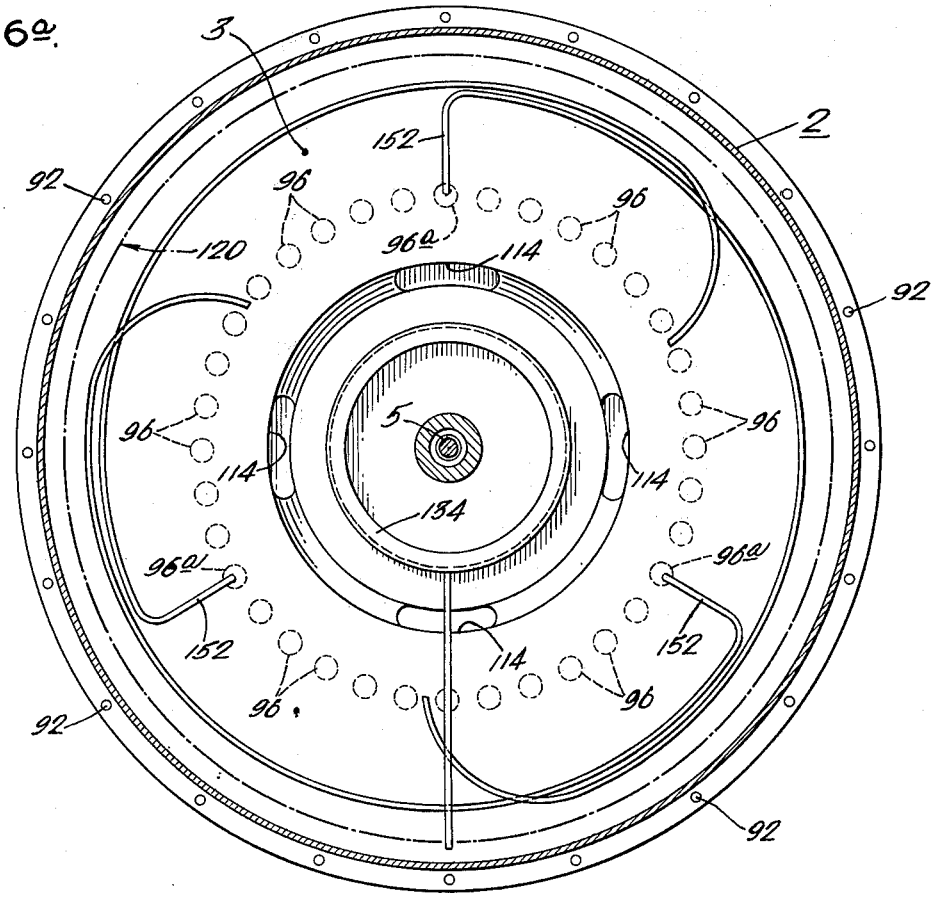

As previously stated, liquid refrigerant is distributed from the expander chamber 88 to all of the evaporator tubes 96 except at least one or a small number that have their inner ends closed. This one or small number of tubes 96, for example three circumferentially equally spaced tubes designated **96*a*, are closed at their inner ends by a disk or plug 148 having a central opening therein in which is secured the axially extending inner end portion 150 of a tube 152. As shown in FIG. 6*a* of the drawings, each of the tubes 152** initially extends radially outward, thence 180° around the interior of the housing H with the free end portion thereof disposed radially inward and terminating just radially outward from the liquid level *x* in the expander and evaporator tubes. Lubricant that migrates into the refrigerant system will not evaporate in the evaporator tubes 96 but will flow through manifold 106 and collect in the several tubes **96*a* that are closed against entrance of refrigerant thereto by the plugs 148. Lubricant collecting in the tubes 96*a* flows inwardly therein and is returned to the lubricant bath 120 by the tubes 152. By extending the tubes 152 180° within the housing as described, the refrigerant is prevented from draining from the evaporator E when the apparatus is not rotating, and by disposing the free end portions of said tubes 152 radially inward as described the proper pressure difference is provided to control discharge of the purged lubricant from said tubes 152.**

Any refrigerant migrating through the tubes 152 to the bath 120 will be vaporized since the temperature of the bath is well above the evaporator temperature although at the same pressure. Refrigerant vaporized from the bath 120 joins the evaporated refrigerant returned through the openings 114 to the housing H and is again compressed by the compressor P.

In normal operation of the described cooling and heating apparatus, the motor M drives the housing-condenser-evaporator unit at a predetermined speed of rotation and the latter through the internal gear train drives the compressor shaft 28 and rotor 26 at the desired speed of rotation relative to the speed of the housing-condenser-evaporator unit determined by the fixed-ratio of the gear train. In the embodiment of the invention shown, the direction of rotation of the shaft 28 is opposite the direction of rotation of the housing-condenser-evaporator unit.

The vaporized refrigerant in the housing H enters the compressor P through openings 36 and passages 38, is compressed by the rotor 26 and discharged through passages 64 to the annular refrigerant chamber 40. The compressed refrigerant then enters the heat exchange tubes 68 of the condenser C where it is condensed by the cooling fluid discharged outwardly between the condenser fins 66 as previously described. The condensed refrigerant returns to the annular chamber 40 and is discharged through the tubes 86 to the expander chamber 88 and tubes 96 of the evaporator E. The vaporized refrigerant then flows through openings 114 in the housing wall 3 and returns to the compressor P to be again compressed, condensed and vaporized as described.

In a typical experimental example of an expander embodying the invention as shown in FIG. 2, the outer radius of the expander chamber was 2.5 inches from the rotation axis, the axial width of said chamber was 0.054 inches and the radius of the liquid level $x$ was 1.0 inches from the rotation axis. Using Freon C-318 as the refrigerant supplied to the chamber through an inlet orifice having a diameter of 0.094 inches located at a center-line radius of 2.41 inches from the rotation axis, and rotatably driving the apparatus at a speed of 4050 rpm, the following data were obtained:

| | |
|---|---|
| Liquid inlet temperature (° F.) | 90.0 |
| Liquid inlet saturation pressure (psig) | 42.4 |
| Liquid flow rate (lb/min) | 0.9 |
| Inlet liquid equilibrium radius (in) | 2.0 |

In the foregoing experiment, as well as in the several experiments hereinafter set forth, the inlet pressure corresponded to the saturation pressure of the liquid at the ambient inlet temperature and the exit pressure was fixed at the ambient atmospheric pressure. In operation, the inlet liquid level assumed an equilibrium radius corresponding to the liquid level $y$ in the feed tubes 86, at which the centrifugal pressure developed by the radial liquid leg between levels $x$ and $y$ at the rotational speed and density of the liquid, exactly balanced the saturation gauge pressure of the inlet liquid less the pressure loss required to maintain flow through the inlet orifice into the expander chamber.

The present invention is not limited to cooling and heating apparatus in which the housing-condenser-evaporator unit is rotationally driven by an external source of rotary power such as the motor M. Alternatively, the compressor shaft and rotor may be rotationally driven by an internal source of rotary power such as an electric motor mounted within the rotary housing H and an internal fixed-ratio gear train employed to drive the rotary housing-condenser-evaporator unit from the compressor shaft, for example, as shown and described in my aforesaid patent application Ser. No. 457,374, filed Apr. 2, 1974, now U.S. Pat. No. 3,911,694.

A modification of the embodiment shown in FIGS. 1–6 of the drawings is shown in FIG. 7 and comprises a two-stage expander RX′ having a pair of axially spaced annular expansion chambers 88*a* and 88*b*. The chambers 88*a* and 88*b* are formed respectively by annular plate members 90*a* and 90*b* secured to the housing side wall 3, for example, by bolts 92*a*, and a closed annular insulating chamber 150 is formed between the expansion chambers 88*a* and 88*b* by an annular plate structure 152. Also the expander chamber 88*a* is insulated from the lubricant bath 120 by suitable insulation 147′.

As in the case of the expansion chamber 88 in the first embodiment, each of the chambers 88*a* and 88*b* as well as the insulating chamber 150 have a substantial radial dimension and a comparatively short axial dimension. Extending radially through the insulating chamber 150 is a plurality of circumferentially equally spaced tubes 154 that have their inner ends in communication with the inner peripheral portion of the first stage expansion chamber 88*a* and their outer ends in communication with the other peripheral portion of the second stage chamber 88*b*. Condensed liquid refrigerant in the annular condensate collection chamber 40 is supplied to the first stage expansion chamber 88*a* at the outer periphery thereof by the feed tube 86 as in the first embodiment, and both expansion chambers 88*a* and 88*b* are provided with a plurality of radial baffles (not shown), such as the baffles 92 in the first embodiment, to maintain the angular velocity of the liquid in said chambers substantially the same as the angular velocity of the rotary housing H.

In operation, liquid refrigerant flows radially inward within the first stage expansion chamber 88*a* to fill the latter with liquid to the surface level $x^1$ and partially vaporized refrigerant at the inner peripheral portion thereof flows radially outward through the tubes 154 to the outer peripheral portion of the second stage expansion chamber 88*b* which is filled with liquid refrigerant to the surface level $x^2$. Refrigerant liquid and vapor entering the second stage chamber 88*b* from the first stage chamber 88*a* will flow radially inward through the second stage chamber 88*b* without disrupting the liquid therein due to the high gravitational field resulting from rotation of the system which retains the liquid in the chamber 88*b* and ensures that the liquid is not blown out of the chamber.

The radius of the outer periphery of the chambers 88*a* and 88*b* and the radii of the liquid surface levels $x^1$ and $x^2$ in the respective chambers are predetermined in correlation to one another and the rotational speed of the housing so that first stage expansion chamber 88*a* and their outer ends in communication with the outer peripheral portion of the second stage chamber 88*b*. Condensed liquid refrigerant in the annular condensate collection chamber 40 is supplied to the first stage expansion chamber 88*a* at the outer periphery thereof by the feed tubes 86 as in the first embodiment, and both expansion chambers 88*a* and 88*b* are provided with a plurality of radial baffles (not shown), such as the baffles 92 in the first embodiment, to maintain the angular velocity of the liquid in said chambers substantially the same as the angular velocity of the rotary housing H.

In operation, liquid refrigerant flows radially inward within the first stage expansion chamber 88*a* to fill the latter with liquid to the surface level $x^1$ and partially vaporized refrigerant at the inner peripheral portion thereof flows radially outward through the tubes 154 to the outer peripheral portion of the second stage expansion chamber 88*b* which is filled with liquid refrigerant to the surface level $x^2$. Refrigerant liquid and vapor entering the second stage chamber 88*b* from the first stage chamber 88*a* will flow radially inward through the second stage chamber 88*b* without disrupting the liquid therein due to the high gravitational field resulting from rotation of the system which retains the liquid in the chamber 88*b* and ensures that the liquid is not blown out of the chamber.

The radius of the outer periphery of the chambers 88a and 88b and the radii of the liquid surface levels $x^1$ and $x^2$ in the respective chambers are predetermined in correlation to one another and the rotational speed of the housing so that the behavior of the refrigerant in each of said chambers is substantially the same as described in the single chamber 88 of the first embodiment of the invention. The pressure drop obtained in this two-stage embodiment is the sum of the pressure drop in each stage of the expander, and since this arrangement provides a greater pressure drop between the condenser C and the evaporator E than can be accommodated in the singlestage first embodiment, it may be preferred for certain installations.

Another embodiment of the invention incorporating a multi-stage expander is shown in FIGS. 8 and 9 of the drawings and may be preferred over the arrangement of FIG. 7 since it is more compact, has shorter axial length, and is characterized by less liquid hold up. Referring to FIGS. 8 and 9 the embodiment of the invention shown comprises a three-stage expander RX″ in which the three stages are disposed in a circular arrangement in the sme plane radially with respect to the axis of rotation of the housing H.

As shown in FIGS. 8 and 9, the three-stage expander RX″ is defined by an annular radial plate 90*c* having inner and outer axial end flanges 90*d* and 90*e*, respectively, secured axially adjacent the housing side wall 3, for example, by bolts 92*b* to provide a compartment of short axial dimension and elongated radial dimension having its periphery substantially the same as the periphery of the housing H. The compartment thus formed is sub-divided into a series of three circumferentially equally spaced, interconnected expansion chambers 88*c*, 88*d* and 88*e* alternately disposed with intermediate insulating chambers 160, 160*a* and 160*b*, respectively, by means of a plurality of radial and circumferential partitions or baffles arranged as shown in FIG. 9. Also the expander chambers 88*c*, 88*d* and 88*e* are insulated from the lubricant bath 120 by suitable insulation 147″.

As shown in FIG. 9, the radial and circumferential partitions in the compartments are constructed and arranged to also provide radial and circumferential passages 161 and 162 for the flow of refrigerant from expansion chamber 88*c* to chamber 88*d* and similar passages 163 and 164 for flow of refrigerant from chamber 88*d* to the chamber 88*e*. From the expansion chamber 88*e* refrigerant flows through an arcuate outlet opening 165 into an annular evaporator chamber 166 defined by a plate member 167 secured axially adjacent the housing side wall 3 and plate 90*c* and to which the evaporator tubes 96 are secured and communicate.

In operation, liquid refrigerant is supplied from the annular condensate chamber 40 through a single feed tube 86 centrally to the outer periphery of the first stage expansion chamber 88*c* as indicated at 168 in FIG. 9. The liquid flows radially inward through the chamber 88*c* to the level indicated at $x^3$ where quiet convective boiling occurs producing some vapor. From the chamber 88c liquid and vapor flow radially outwardly through passage 161 and then through circumferential passage 162 to the second stage chamber 88*d* to the level indicated at $x^4$ where further expansion of the refrigerant takes place in the same manner as in the first stage chamber 88*c*. From the second stage chamber liquid and vapor flow radially outward through passage 163 and circumferential passage 164 to the third stage chamber 88*e* to the level indicated at $x^5$ where still further expansion of the refrigerant continues as before. The insulating chambers 160, 160*a* and 160*b* thermally isolate the respective expansion chambers 88*c*, 88*d* and 88*e*, and the evaporator chamber 166 is insulated from said expander chambers by suitable insulation 169.

As in the previous embodiments, the radius of the outer periphery of the chambers 88*c*, 88*d* and 88*e* and the radius of the liquid levels $x^3$, $x^4$ and $x^5$ are predetermined in correlation to one another and the rotation speed of the housing so that the liquid refrigerant in each chamber behaves as previously described. The pressure drop between the first and second stage expansion chambers 88*c* and 88*d* and between chambers 88*d* and 88*e* is determined by the differences in the liquid levels $x^3$ and 172, and $x^4$ and 173, respectively. Vapor and liquid exit from the third stage chamber 88*e* through the arcuate outlet openings 165 to the chamber 166 and the liquid fills said chamber and the evaporator tubes to the level $x^6$. The liquid is vaporized in the tubes 96 of the evaporator E while the vapor flows directly through the housing openings 114 to the compressor E, along with the refrigerant vaporized in the evaporator, to be again compressed, condensed and evaporated.

In a typical experimental example of an expander embodying the invention shown in FIGS. 8 and 9, the outer radius of the several expander chambers 88*c*, 88*d* and 88*e* was 1.97 inches from the rotation axis, the axial width of each of said chambers was 0.25 inches and the radius of the liquid levels $x^3$, $x^4$ and $x^5$ was 1.0 inches from the rotation axis. Using Freon C-318 as the refrigerant supplied to the chamber through an inlet orifice having a diameter of 0.094 inches located at a center-line radius of 1.75 inches from the rotation axis, and rotatably driving the apparatus at a speed of 3000 rpm, the following data were obtained:

| | |
|---|---|
| Liquid inlet temperature (° F.) | 90.0 |
| Liquid inlet saturation pressure (psig) | 42.4 |
| Liquid flow rate (lb/min) | 0.8 |
| Inlet liquid equilibrium radius (in.) | 1.0 |

In the foregoing experiment, the liquid refrigerant is essentially at its saturation pressure upon entering the expander and partially vaporizes during passage through the expander which must permit passage of both liquid and vapor without loss of the overall pressure seal. The calculated static pressure sealing capacity for the three stages of the expander for the above operating conditions is 0, 19 and 19 psi, respectively, giving a total of 38.0 psi which, subtracted from the liquid inlet saturation pressure of 42.4 psig. leaves a reasonable value of 4.4 psi for the flow pressure losses.

A still further embodiment of the invention is shown in FIG. 10 of the drawings. This embodiment is essentially the same as the first embodiment shown and described except that a capillary tube expander is employed in advance of the adiabatic expansion chamber 88. In accordance with this embodiment one or more capillary tubes 175 are connected to corresponding liquid refrigerant feed tubes 86 and coiled within the chamber 88 around the outer periphery thereof. Thus liquid refrigerant from the feed tubes 86 flows first through the capillary tubes 175 where it is cooled by the cold liquid in the expansion chamber 88 and hence the liquid exists from the capillary tubes 175 into the chamber 88 in a sub-cooled condition despite the capillary tube pressure drop so that no boiling occurs at the outlet from the capillary tubes 175. This arrangement provides a greater pressure drop between the condenser and the evaporator than the arrangement shown in FIGS. 1 and 2 of the drawings.

In a typical experimental example of an expander embodying the invention as shown in FIG. 10, the outer radius of the expander chamber was 2.5 inches from the rotation axis, the axial width of said chamber was 0.090 inches and the radius of the liquid level $x$ was 1.0 inches from the rotation axis. Three turns of a capillary tube, such as 175 in said FIG. 10, having 0.067 inch i.d. were wrapped circumferentially within the expander chamber at a radius of 2.41 inches from the rotation axis. Using Freon 114 as the refrigerant supplied to the chamber and rotatably driving the apparatus at a speed of 3200 rpm, the following data were obtained:

| | |
|---|---|
| Liquid inlet temperature (° F.) | 83.0 |
| Liquid inlet saturation pressure (psig) | 19.7 |
| Liquid flow rate (lb/min) | 1.1 |
| Inlet liquid equilibrium radius (in.) | 1.18 |

From the foregoing, it will be observed that the present invention provides rotary cooling apparatus embodying a novel refrigerant expander that operates essentially adiabatically with no nucleate of the refrigerant in the expander. The expander of the invention is of comparatively simple inexpensive construction with no moving parts and operates in a highly stable manner devoid of any pressure temperature or flow rate pulses to provide reliable automatic refrigerant flow control for all operating conditions without the necessity for any complicated control mechanisms.

While certain embodiments of the invention have been illustrated and described herein, it is not intended to limit the invention to such disclosures and it is contemplated that changes and modifications may be made in and to the invention within the scope of the following claims:

We claim:

1. Rotary cooling and heating apparatus comprising:

a cylindrical housing mounted for rotation about the axis thereof, a compressor in the housing for rotation therewith including a coaxial rotor rotatable independently relative to said housing for compressing refrigerant, means operable to rotatably drive the compressor rotor and housing respectively at predetermined different speeds, a condenser mounted coaxially of the housing and rotatable therewith operable to receive compressed refrigerant from the compressor and condense same, a refrigerant expander rotatable with the housing comprising at least one radial expansion chamber having the outer periphery thereof disposed at a predetermined radius from the rotation axis of the housing and adapted to be filled with liquid refrigerant to a surface level disposed at a predetermined radius from said rotation axis which is less than the radius to the outer periphery, said radii being predetermined in correlation to one another and to the rotation speed of the housing to provide a pressure drop across the expander operable at the temperature difference between the warmer liquid at the periphery of the expansion chamber and the cooler liquid at said surface level to cause radial circulation and intermixing of the warmer and cooler liquid refrigerant and prevent nucleate boiling of the refrigerant in said chamber while permitting quiescent convective boiling and partial vaporization of the liquid at said surface level, means for supplying liquid refrigerant to the outer periphery of said expansion chamber operable to fill the latter to said surface level, a refrigerant evaporator mounted coaxially of the housing and rotatable therewith connected to the expander to receive liquid refrigerant therefrom and vaporize same, and means for returning vaporized refrigerant to the compressor.

2. Apparatus as claimed in claim 1 wherein the refrigerant evaporator comprises a plurality of axially spaced annular fins having a plurality of circumferentially equally spaced heat exchange tubes extending longitudinally therethrough and the liquid refrigerant is vaporized in said heat exchange with a fluid discharged outwardly through said fins.

3. Apparatus as claimed in claim 2 wherein the condenser comprises a plurality of axially spaced annular fins having a plurality of circumferentially equally spaced heat exchange tubes extending longitudinally therethrough and the compressed refrigerant is condensed in said heat exchange tubes by heat exchange with a fluid discharged outwardly through said fins.

4. Apparatus as claimed in claim 3 wherein the annular fins of the condenser and evaporator have predetermined inner and outer radii ratios and the axial spacing between said fins is correlated to the speed of rotation of the housing and the viscous properties of the heat exchange fluid to have a Taylor number operable at said radii ratios to convey and accelerate said heat exchange fluid by viscosity shear forces spirally outward between said fins of the condenser and evaporator substantially to the velocity providing optimum heat exchange between the heat exchange fluid and the refrigerant in the heat exchange tubes of said condenser and evaporator.

5. Apparatus as claimed in claim 2 wherein the refrigerant expander comprises a single annular expansion chamber and the liquid surface level therein is disposed at the same radius from the rotation axis as the central axes of the heat exchange tubes of the evaporator whereby said tubes are maintained substantially half filled with liquid refrigerant.

6. Apparatus as claimed in claim 5 wherein the means for supplying liquid refrigerant to the outer periphery of the expansion chamber includes at least one capillary tube expander constructed and operable to provide a greater pressure drop across the refrigerant expander.

7. Apparatus as claimed in claim 1 wherein the refrigerant expander is of two stage construction comprising a pair of axially adjacent radial expansion chambers each having its periphery disposed at a predetermined radius from the rotation axis and an inner liquid surface level disposed at a radius from said axis less thean the periphery radius predetermined in correlation to the periphery radius and the speed of rotation of the housing to prevent nucleate boiling of liquid refrigerant therein, means for supplying condensed liquid refrigerant to the outer periphery of the first stage expansion chamber to fill the latter to said surface level, means for conducting liquid and vaporized refrigerant from the inner periphery of said first stage expansion chamber to the outer periphery of the second stage expansion chamber to fill the latter to the predetermined surface level therein.

8. Apparatus as claimed in claim 7 wherein the refrigerant evaporator comprises a plurality of axially spaced annular fins having a plurality of circumferentially equally spaced heat exchange tubes extending longitudinally therethrough and the liquid refrigerant is vaporized in said heat exchange with a fluid discharge outwardly through said fins.

9. Apparatus as claimed in claim 8 wherein the condenser comprises a plurality of axially spaced annular fins having a plurality of circumferentially equally spaced heat exchange tubes extending longitudinally therethrough and the compressed refrigerant is condensed in said heat exchange tubes by heat exchange with a fluid discharged outwardly through said fins.

10. Apparatus as claimed in claim 9 wherein the annular fins of the condenser and evaporator have predetermined inner and outer radii ratios and the axial spacing between said fins is correlated to the speed of rotation of the housing and the viscous properties of the heat exchange fluid to have a Taylor number operable at said radii ratios to convey and accelerate said heat exchange fluid by viscosity shear forces spirally outward between said fins of the condenser and evaporator substantially to the velocity providing optimum heat exchange between the heat exchange fluid and the refrigerant in the heat exchange tubes of said condenser and evaporator.

11. Apparatus as claimed in claim 8 wherein the evaporator heat exchange tubes have their central axes disposed at the said radius from the rotation axis as the predetermined liquid surface level in the second stage expansion chamber whereby said evaporator tubes are maintained substantially half filled with liquid refrigerant.

12. Apparatus as claimed in claim 7 wherein the first and second stage expansion chambers are disposed in axially spaced relation and the expander is constructed to provide an insulating chamber therebetween, and the means for supplying liquid and vaporized refrigerant from the first stage expansion chamber to the second stage expansion chamber comprises at least one conduit extending radially within said insulating chamber.

13. Apparatus as claimed in claim 1 comprising a refrigerant expander including means defining a series of equally circumferentially spaced radial expansion chambers disposed in a common plane normal to the rotation axis of the housing, each of said expansion chambers having its periphery disposed at a predetermined radius from said rotation axis and an inner liquid surface level predetermined in correlation to the periphery radius and the rotation speed of the housing to prevent nucleate boiling of liquid refrigerant therein, means for supplying condensed liquid refrigerant to the first of said series of expansion chambers at the periphery thereof to fill the same with liquid to said surface level therein, means in the expander for supplying liquid and vaporized refrigerant from the inner periphery of each expansion chamber in said series to the outer periphery of the next expansion chamber in said series including the last chamber in the series to fill said chambers successively with liquid refrigerant to the predetermined inner liquid surface level therein, an evaporator chamber to receive liquid refrigerant from the last expansion chamber in said series and supply same to the evaporator heat exchange tubes, and means for discharging liquid refrigerant from the inner liquid surface level of said last expansion chamber to said evaporator chamber and fill same to a predetermined inner liquid surface level therein.

14. Apparatus as claimed in claim 13 wherein the refrigerant evaporator comprises a plurality of axially spaced annular fins having a plurality of circumferentially equally spaced heat exchange tubes extending longitudinally therethrough and the liquid refrigerant is vaporized in said heat exchange with a fluid discharged outwardly through said fins.

15. Apparatus as claimed in claim 14 wherein the condenser comprises a plurality of axially spaced annular fins having a plurality of circumferentially equally spaced heat exchange tubes extending longitudinally therethrough and the compressed refrigerant is condensed in said heat exchange tubes by heat exchange with a fluid discharged outwardly through said fins.

16. Apparatus as claimed in claim 15 wherein the annular fins of the condenser and evaporator have predetermined inner and outer radii ratios and the axial spacing between said fins is correlated to the speed of rotation of the housing and the viscous properties of the heat exchanger fluid to have a Taylor number operable at said radii ratios to convey and accelerate said heat exchange fluid by viscosity shear forces spirally outward between said fins of the condenser and evaporator substantially to the velocity providing optimum heat exchange between the heat exchange fluid and the refrigerant in the heat exchange tubes of said condenser and evaporator.

17. Apparatus as claimed in claim 14 wherein the evaporator heat exchange tubes have their central axes disposed at the same radius from the rotation axis as the predetermined liquid surface level in the evaporator chamber whereby said evaporator tubes are maintained substantially half filled with liquid refrigerant.

18. Apparatus as claimed in claim 13 wherein the radial expansion chambers are circumferentially spaced apart from each other, and the expander is constructed to provide an insulating chamber between adjacent expansion chambers.

19. Apparatus as claimed in claim 1 wherein the means for supplying liquid refrigerant to the outer periphery of the expansion chamber includes at least one capillary tube expander constructed and operable to provide a greater pressure drop across the refrigerant expander.

* * * * *